US006593895B2

(12) United States Patent
Nesic et al.

(10) Patent No.: US 6,593,895 B2
(45) Date of Patent: Jul. 15, 2003

(54) PRINTED DIPOLE ANTENNA WITH DUAL SPIRALS

(75) Inventors: Aleksandar Nesic, Beograd (YU); Veselin Brankovic, Esslingen (DE)

(73) Assignee: Sony International (Europe) GmbH, Berlin (DE)

( * ) Notice: Subject to any disclaimer, the term of this patent is extended or adjusted under 35 U.S.C. 154(b) by 0 days.

(21) Appl. No.: 10/178,688

(22) Filed: Jun. 24, 2002

(65) Prior Publication Data

US 2003/0006938 A1 Jan. 9, 2003

(30) Foreign Application Priority Data

Jun. 26, 2001 (EP) ..... 01115380

(51) Int. Cl.[7] ..... H01Q 9/28

(52) U.S. Cl. ..... 343/795; 343/893; 343/895; 343/912; 343/700 MS

(58) Field of Search ..... 343/795, 767, 343/793, 796, 810, 812, 817, 824, 834, 893, 895, 912, 905, 700 MS

(56) References Cited

U.S. PATENT DOCUMENTS

| | | | | |
|---|---|---|---|---|
| 4,494,100 A | | 1/1985 | Stengel et al. | 336/200 |
| 6,166,694 A | * | 12/2000 | Ying | 343/702 |
| 2001/0048399 A1 | * | 12/2001 | Oberschmidt et al. | 343/895 |

OTHER PUBLICATIONS

Patent Abstracts of Japan, vol. 012, No. 077, Mar. 10, 1988, JP 62 216407.
Patent Abstracts of Japan, vol. 014, No. 467, Oct. 11, 1990, JP 02 190007.

* cited by examiner

*Primary Examiner*—Don Wong
*Assistant Examiner*—Thuy Vinh Tran
(74) *Attorney, Agent, or Firm*—Frommer Lawrence & Haug LLP; William S. Frommer; Hans R. Mahr

(57) ABSTRACT

The present invention relates to an antenna (1), comprising a dielectric substrate (2) comprising a front (3) and a back (4) dielectric face, at least one dipole element comprising a first (5) and a second (6) element for radiating and receiving electromagnetic signals, said first element (5) being printed on said front face (3) and said second element (6) being printed on said back face (4), said first and said second element having a spiral shape, respectively, both spirals being open, and metal feeding elements for supplying signals to and from said dipole element, said metal feeding elements comprising a first line (7) printed on said front face (3) and to said first element (5) coupled at a first feeding point and a second line (8) printed on said back (4) face and coupled to said second element (6) at a second feeding point, said first and said second feeding point overlapping each other. The present invention further relates to a phased array antenna comprising a plurality of proposed single antenna elements (1) with a feeding network based on tapered structures.

17 Claims, 8 Drawing Sheets

PRINTED DIPOLE ANTENNA WITH DUAL SPIRALS

TECHNICAL BACKGROUND

The present invention relates to an antenna for radiating and receiving circular polarised electromagnetic signals, in particular signals in the microwave or mm-wave frequency range.

The recent developments in commercial microwave and millimeter-wave communication systems are tremendous. Possible mass market applications are broad band home networks, wireless LANs, private short radio links, automotive mm-wave radars, microwave radio and TV distribution systems (transmitters and ultra low cost receivers). Particularly, the frequency band of 59 to 64 GHz is becoming very important for short range high data rate communication in respect of a large variety of practical applications starting from very high data rate WLANs to HD video transmission for indoor applications. Due to the possible mass market introduction of hand-held devices for these applications, a need for cheap and effective circular polarised antennas with high gain exists. Circular polarised antennas have the principal advantage, that no need for a proper orientation of the antenna is necessary, unlike linear polarised antennas, so that circular polarised antennas only need to be pointed to the direction of the data transmission. Moreover, if reflected transmission waves are approaching the receiver, these reflected waves have a changed polarisation compared to the waves of the not reflected main path. Thus, more simple modulation schemes are possible particularly for the 60 GHz operation range.

Circular polarised antennas with dipole means for radiating and receiving electromagnetic signals are known in many different variations. E.g. K. Hirose, K. Kawai, H. Nakano "An array antenna composed of outer-fed curl elements" IEEE AP-S 1998, 0-7803-4478-2/98 describe an antenna with more than one spiral shaped element attached to one feed line. The proposed antenna structure has the disadvantage, that a full multi element high gain beam antenna cannot be realised on the basis of the proposed approach. For the feeding of the antenna, a microstrip line is proposed and the dipole portions of the antennas are displaced and do not have a feeding point at the same location. Generally, the solution proposed in this article suffers from the disadvantage of a small operation bandwidth and a small axial ratio bandwidth and further that a high gain operation and a planar feeding of the antenna structure is not possible.

R. Ramirez, N. Alexopoulos "Single proximity feed microstrip alchimedean spiral antennas" IEEE AP-S 1998, 0-7803-4478-2/98 propose circular polarised antenna elements with spiral shape dipole structures, whereby the feeding of the spiral shaped radiating elements is done in the middle of the elements. Although spiral shape elements fed in the middle are known for providing a high operation bandwidth, this kind of feeding has the drawback of a large geometrical size and very limited gain.

SUMMARY OF THE INVENTION

The object of the present invention is therefore to provide a circular polarised antenna with a dipole means comprising a first and a second element for radiating and receiving electromagnetic signals, whereby the first and the second element have a spiral shape, which can be manufactured in a simple and cost effective way and which can be operated with a high gain.

The above object is achieved by an antenna according to claim 1, comprising a dielectric substrate comprising a front and a back dielectric face, at least one dipole means comprising a first and a second element for radiating and receiving electromagnetic signals, said first element being printed on said front face and said second element being printed on said back face, said first and said second element having a spiral shape, respectively, both spirals being open, and metal feeding means for supplying signals to and from said dipole means, said metal feeding means comprising a first line printed on said front face and coupled to said first element at a first feeding point and a second line printed on said back face and coupled to said second element at a second feeding point, said first and said second feeding point overlapping each other.

The proposed new antenna is a circular polarised antenna which can be manufactured in a simple and very cost effective way and which can be operated with a high gain in the microwave and mm-wave range. Further, the proposed antenna structure allows a planar feeding which allows simple and easy transition and interface structures for the connection with other processing elements in the high frequency range. Further, the proposed antenna structure allows the integration of other high frequency integrated circuitry components on the same substrate, since the geometrical size of the dipole means is relatively small due to the spiral shape. Further, the proposed antenna geometry can be reproduced easily, which means that the manufacturing tolerances are not critical.

Advantageously, the spirals formed by the first and the second element have a constant radius. In other words, the spirals have a circular shape, so that each element forms a ring. Hereby, the spiral formed by the first and the second element may almost form a closed loop, respectively. One of the general features of the antenna according to the present invention is that the first and second feeding point couples the first and the second feeding line, respectively, to one end of each of the first and the second element, respectively. The other end of the first and the second element is a free or open end. Thus, the first and the second element almost forming a closed loop means that the free or open end of each of the elements is very close to the location were the first and the second feeding points are, but does not touch them.

Alternatively, the spirals by the first and the second element having a constant radius respectively form less than one complete turn.

In an alternative advantageous example of the antenna according to the present invention, the spirals formed by the first and the second element respectively have a decreasing radius toward their respective open end. This means that the radius of the spiral at the beginning, i.e. close to the respective feeding point, is larger and decreases towards the open end of the respective element. Hereby, the spirals formed by the first and the second element, respectively, may advantageously form less than one, one or more than one complete turn depending on the required size and application.

Further advantageously, the width of the first and the second element, respectively, decreases from the respective feeding point towards the respective open end of the spirals. Alternatively, it might by advantageous if the width of the first and the second element, respectively, increases from the respective feeding point towards the respective open end of the spirals.

Further advantageously, the first and the second line of the metal feeding means may be balanced microstrip lines.

Further advantageously, the first and the second line of the metal feeding means extend beyond the respective feeding point.

Further advantageously, a reflector means may be provided, which is spaced to and parallel with the back face of the dielectric substrate, with a low loss material being located between the reflector means and the back face. Hereby, the reflector means are advantageously spaced from the middle of the substrate by a quarter wavelength of the centre frequency of operation of the antenna.

The present invention further provides a phased antenna array comprising a plurality of antennas or antenna elements as described above, whereby the metal feeding means of the antennas are connected to metal transmission structures, respectively printed on the front face and the back face of the dielectric substrate. Hereby, the transmission structures are advantageously balanced and respectively comprise tapered microstrip lines. The tapered microstrip lines advantageously provide improved impedance matching. Further advantageously, a plurality of holes are provided in the substrate. The holes in the substrate on locations were no first and second elements and metal feeding means are printed increase the axial ratio quality of the antenna, whereby at the same time the low cost manufacturing process can be maintained.

BRIEF DESCRIPTION OF THE DRAWINGS

In the following description, preferred embodiments of the present invention are described in more detail in relation to the enclosed drawings, in which.

DETAILED DESCRIPTION OF THE INVENTION

Figure 1:
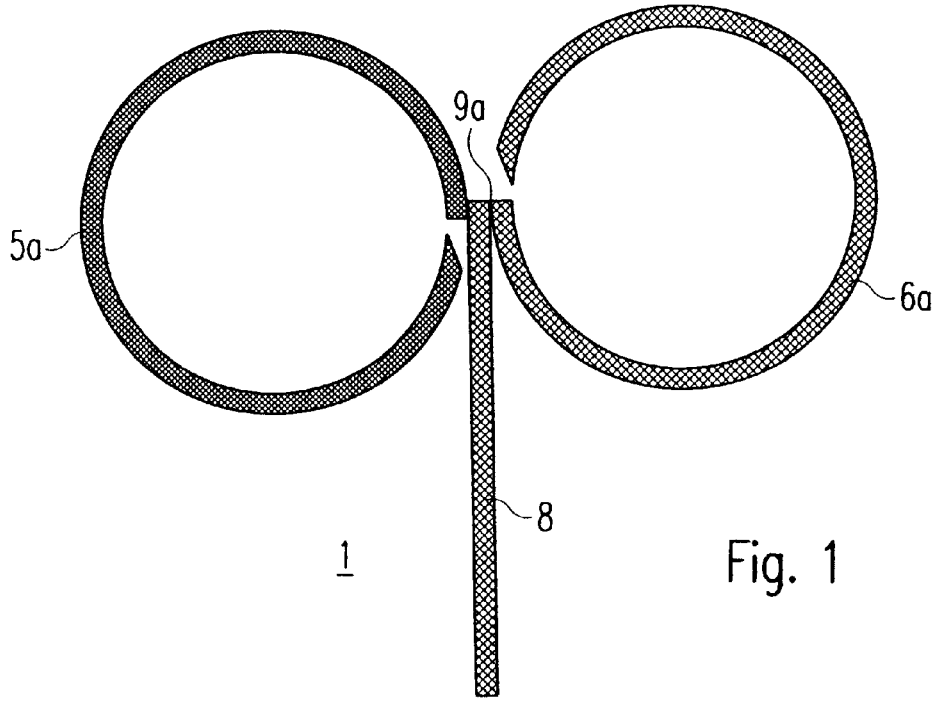
FIG. 1 shows a schematic bottom view of an antenna according to the present invention.
Figure 2:
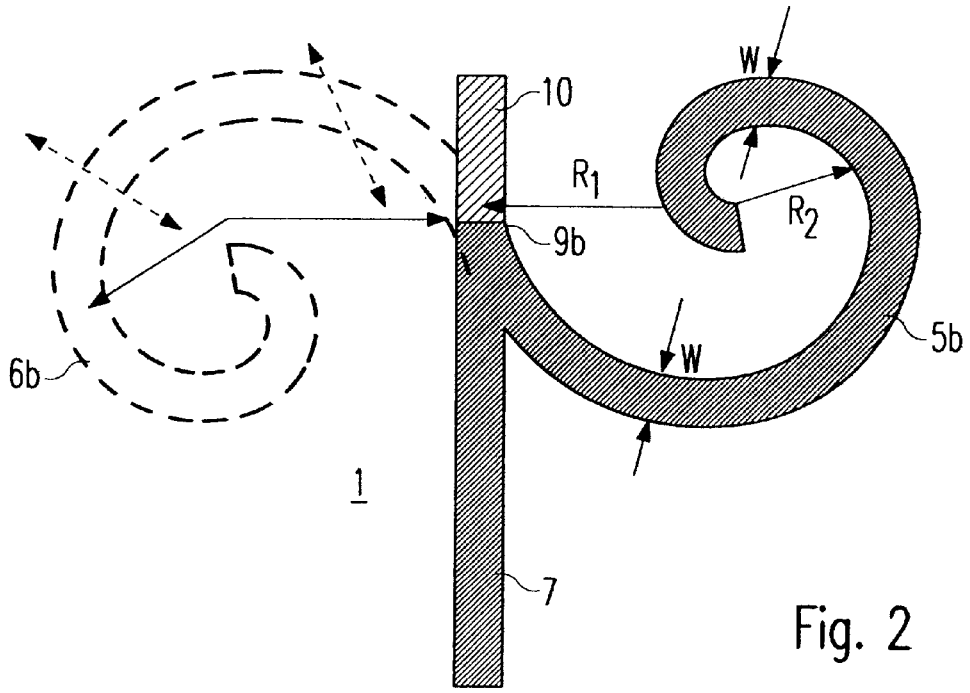
FIG. 2 shows a schematic top view of another example of an antenna according to the present invention.
Figure 3:
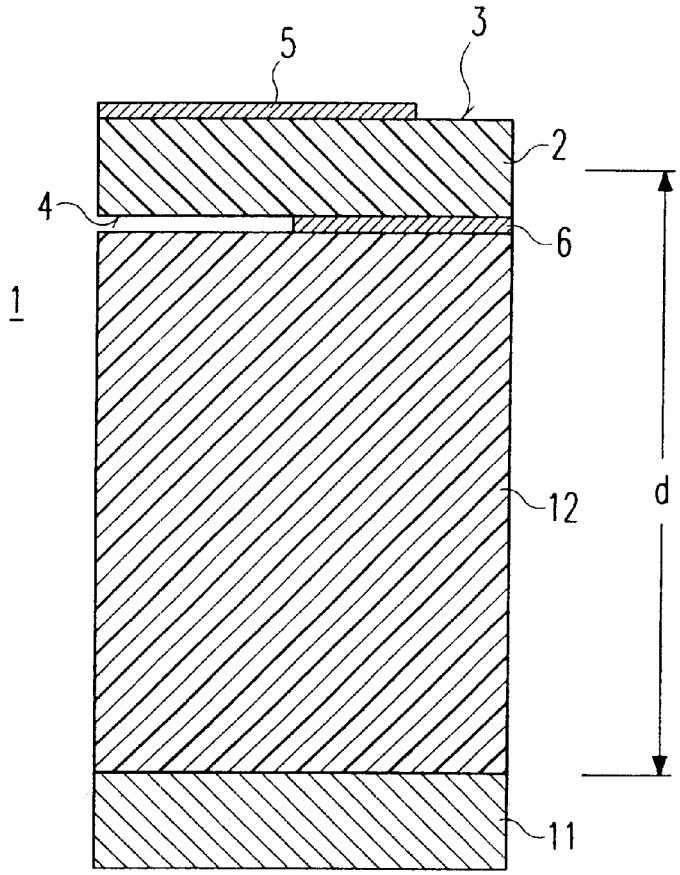
FIG. 3 shows a schematic cross section of the antenna according to the present invention.

FIG. 1 shows a schematic bottom view of a first example of an antenna or antenna element 1 according to the present invention. FIG. 2 shows a schematic top view of a second example of an antenna or antenna element 1 according to the present invention and FIG. 3 shows a general cross section of an antenna 1 according to the present invention.

The antenna 1 according to the present invention is a circular polarised antenna with a dipole means comprising a first element 5 and a second element 6 for radiating and receiving electromagnetic signals in the high frequency range, i.e. the microwave or mm-wave range. The antenna 1 according to the present invention is particularly suited for operation in a range between 5 and 60 GHz. The general shape of the first element 5 and the second element 6 of the dipole means of the antenna 1 according to the present invention is spiral, whereby both spirals are open as can be seen in FIGS. 1 and 2. The first element 5, designated 5*a* in the example shown in FIGS. 1 and 5*b* in the example shown in FIG. 2 is printed onto a front face 3 of a dielectric substrate 2. The sense of rotation of the two spirals forming the dipole means of the antenna 1 of the present invention is respectively opposite to each other. If looking onto the first element 5*b* printed on the front face 3, the sense of rotation from the feeding point is e.g. counter-clockwise as shown in FIG. 2, in which case the sense of rotation of the second element 6*b* printed on the back face 4 is clockwise if looking onto the back face. The case of FIG. 1 is different. Here, if looking onto the back face 4, the rotation sense of the second element 6*a* is counter-clockwise, whereby, if looking onto the front face 3, the sense of rotation of the first element 5*a* is clockwise. The second element 6 designated 6*a* in the example shown in FIGS. 1 and 6*b* in the example shown in FIG. 2 is printed onto a back face 4 of the dielectric substrate 2. The dielectric substrate 2 has a generally planar shape, whereby the front face 3 and the back face 4 are opposing and parallel to each other. The dielectric constant of the dielectric substrate 2 is $\geqq 1$. A suitable material for the dielectric substrate 2 has e.g. a dielectric constant of 2.17.

Figure 4:
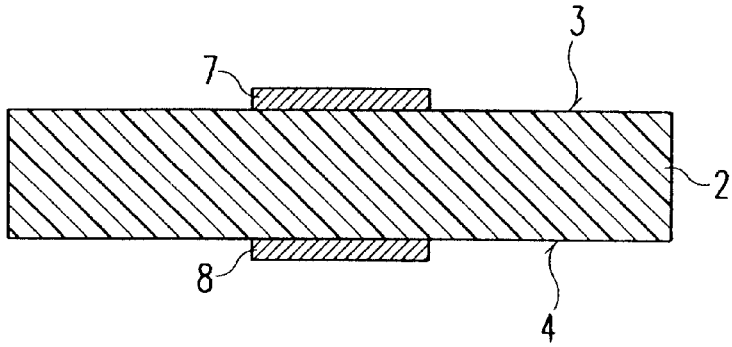
FIG. 4 shows a schematic cross section of a balanced feeding structure for an antenna according to the present invention.

The first element 5 and the second element 6 of the dipole means are metal strips printed onto the front face 3 and the back face 4, respectively. The antenna 1 according to the present invention comprises further metal feeding means for supplying signals to and from the dipole means. The metal feeding means comprises a first microstrip line printed on the front face 3 and coupled to the first element 5 at a first feeding point, designated with the reference numeral 9*b* in FIG. 2. The metal feeding means further comprises a second microstrip line 8 printed onto the back face 4 and coupled to the second element 6 at a second feeding point, which is designated with the reference numeral 9*a* in the example shown in FIG. 1. The first feeding point and the second feeding point overlap each other, which means that they lay on the same line perpendicular to the front face 3 and the back face 4 of the substrate 2. The same is true for the first microstrip line 7 and the second microstrip line 8, which overlap each other to form a balanced microstrip line, a cross section of which can be seen in FIG. 4.

As stated above, the general shape of the first element 5 and the second element 6 of the dipole means is a spiral shape. Hereby, the radius of the spirals may not vary, as shown in FIG. 1, in which the first element 5*a* and the second element 6*a* have a constant radius. In the example shown in FIG. 2, the first element 5*b* and the second element 6*b* have a decreasing radius from the first feeding point and second feeding point, respectively, towards the open end of the respective element.

In the example shown in FIG. 1, the first element 5*a* and the second element 6*a* almost form a closed loop or ring in an angular range at about 350–359 degrees, respectively, whereby the open or free end of each element almost touches the respective feeding point. In an alternative embodiment, which is not shown, the radius of the first element 5*a* and the second element 6*a* may still be constant, but the element may form an open ring with e.g. ¾ or half of one turn.

In the example shown in FIG. 2, the radius of the first element 5*b* and the second element 6*b* respectively decreases starting from the respective feeding point and deed of the elements forms more than one turn, more specifically, one turn and a quarter turn. In alternative embodiments, the first element 5*b* and the second element 6*b* may also form less than one turn, exactly one turn or even several turns. In the example shown in FIG. 2, the width W of each of the metal strips forming the first element 5*b* and the second element 6*b* is constant from the feeding point to the free end of each element. However, the width W may increase or decrease depending on the application or performance to be achieved.

As can be seen from FIG. 1 and FIG. 2, the first element 5 and the second element 6 of the dipole means of the antenna 1 according to the present invention do not overlap, but form adjacent spirals on both sides of the microstrip lines 7 and 8. If looking at the front face 3 or back face 4 of the dielectric substrate 2, the rotation centres of the first element 5 and the second element 6 lay on a line perpendicular to the longitudinal axis of the microstrip lines 7 and 8.

Although only shown in the example of FIG. 2, all embodiments of the antenna 1 according to the present invention may have an extension of the microstrip lines 7 and 8 beyond the feeding points. This additional part 10 of the microstrip line 7 and 8 may be advantageous for increasing the antenna matching depending on the length of its extension part 10.

It is further advantageous if the antenna 1 according to the present invention comprises a reflector plane 11 as shown in FIG. 3. The reflector means 11 is e.g. a metal reflector plane which is located on a low loss material 12 on the opposite side of the dielectric substrate 2. The low loss material 12 acts as a supporting structure for a dielectric substrate 2 and the reflector means 11. The low loss material 12 advantageously has a dielectric constant close to 1 and preferably less than 1.2. The low loss material can e.g. be polyurethane, a free space filled with air or other low loss material. The reflector means 11 serves to increase the broad side gain of the antenna. Advantageously, the reflector means 11 is located at a distance d which is about one fourth of the electrical wavelength of the centre frequency of operation of the antenna 1.

Figure 5:
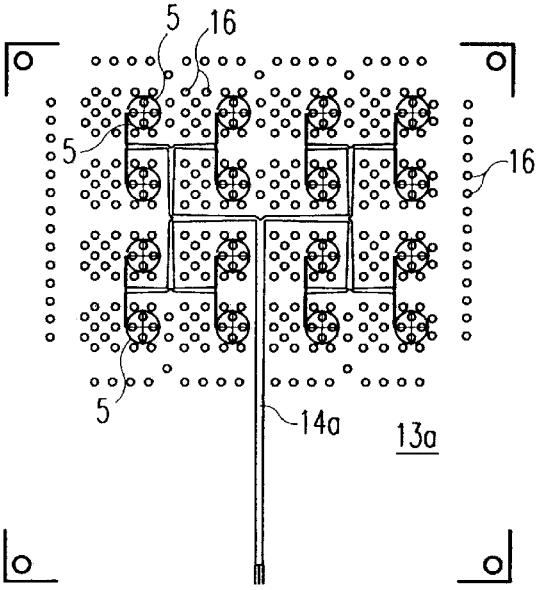
FIG. 5 shows a schematic top view of a phased array antenna according to the present invention.
Figure 6:
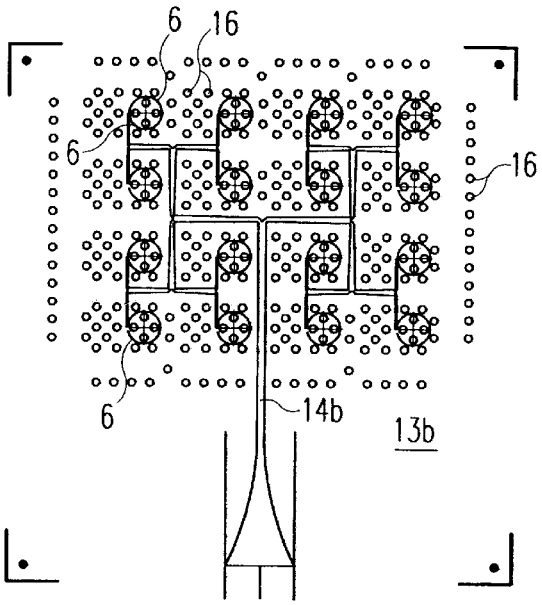
FIG. 6 shows a bottom view of the phased array antenna shown in FIG. 5.
Figure 7:
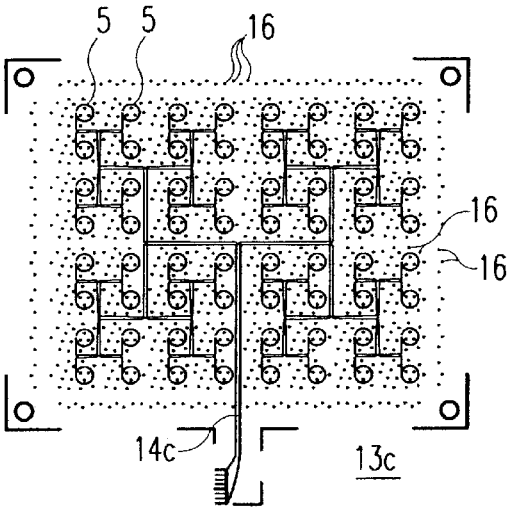
FIG. 7 shows a schematic top view of another example of a phased array antenna according to the present invention.
Figure 8:
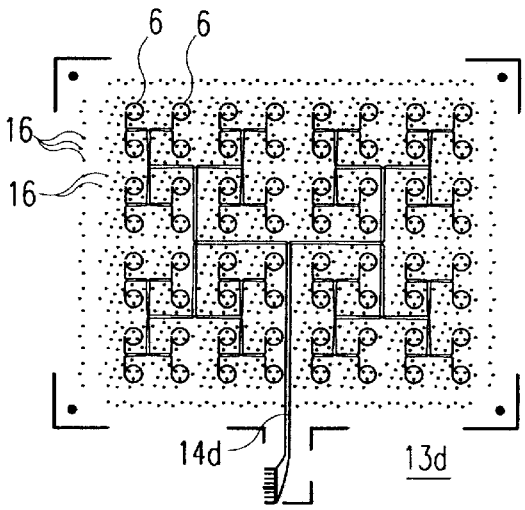
FIG. 8 shows a schematic bottom view of the phased array antenna shown in FIG. 7.
Figure 9:
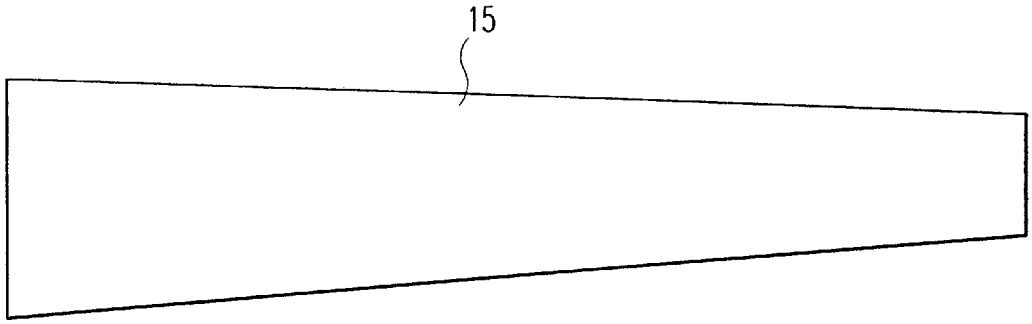
FIG. 9 shows a schematic top view of a tapered microstrip line.
Figure 16:
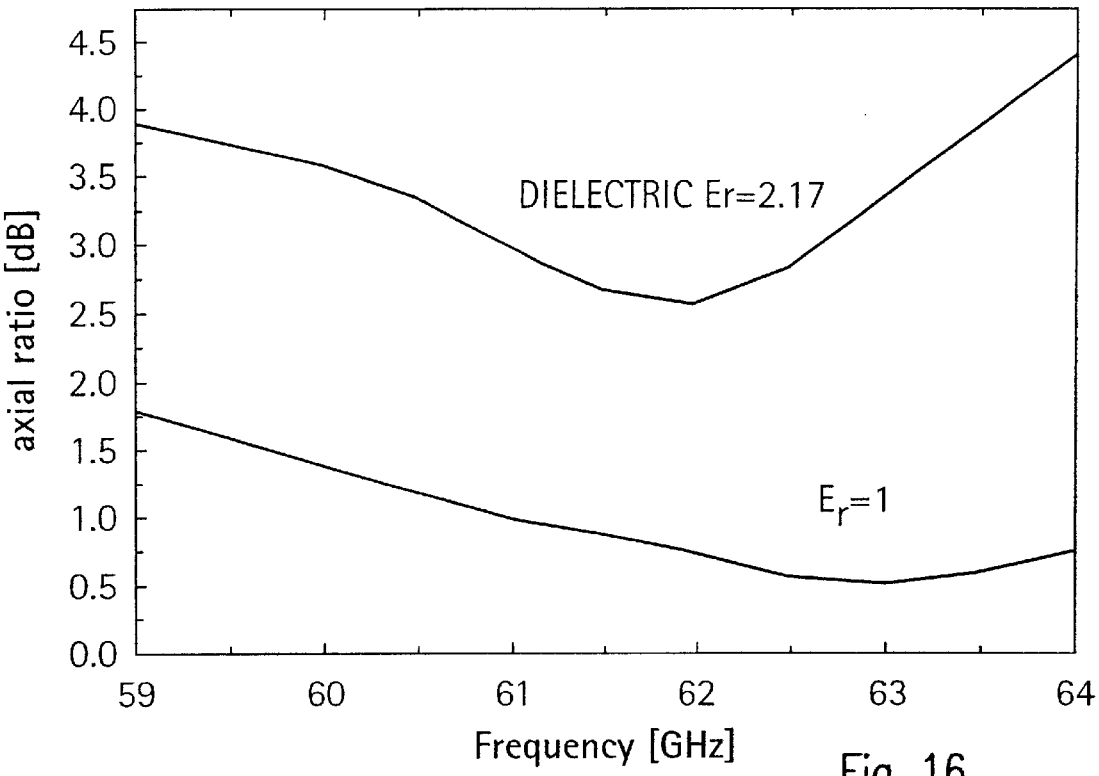
FIG. 16 shows a schematic diagram of the axial ratio over the frequency for a phased array antenna consisting of 2×2 antennas according to the present invention with double turn spirals.

FIG. 5 shows a top view of an example of a phased array antenna according to the present invention and FIG. 6 shows the corresponding bottom view. FIG. 5 hereby shows a view when looking at a front face 3 of a dielectric substrate 2, onto which the phased array antenna is printed. FIG. 6 shows the corresponding bottom view onto the back face 4 of the dielectric substrate 2. The phased array antenna 13 comprises a symmetrically arranged plurality of dipole means. Each dipole means comprises a first element 5 printed onto the front face 3 and a second element 6 printed onto the back face 4. FIG. 7 and FIG. 8 show a corresponding top and bottom view, respectively, of the phased array antenna with a larger number of dipole means as the phased array antenna shown in FIG. 5. The general arrangement, however, is the same. Each dipole means consisting of a first element 5 and a second element 6 is fed and connected to balanced microstrip lines 7 and 8. Only a single element 5 or 6 is connected to one microstrip line 7 or 8. The balanced microstrip lines 7 and 8 are fed by a metal transmission structure 14, which is also printed on the respective front face 3 and back face 4, respectively. The metal transmission structure 14 basically consists of tapered microstrip lines which are connected in T-junctions, so that a rectangular feeding network is formed. An example of a tapered microstrip line 15 is shown in FIG. 9. The transmission structure 14 printed on respective front face 3 and back face 4 are also balanced in respect to each other. As shown in FIGS. 5, 6, 7 and 8, the substrate 2 further comprises a plurality of through-holes 16. The provision of the through-holes 16 and an increasing number of through-holes 16 brings the dielectric constant of the substrate 2 closer to zero, which increases the axial ratio quality, i.e. lowest axial ratio, as can be seen in the diagram of FIG. 16.

It has to be understood that the phased array antenna according to the present invention may comprise antenna elements with dipole means according to any of the shapes described above. The phased array antenna shown in FIGS. 5 and 6 comprises 4×4 single antennas 1 and is particularly suited for an operation in the 15 GHz range. Further, the transition of the transmission structure 14 from a balance microstrip line to an unbalance microstrip line is shown. The phased array antenna shown in FIGS. 7 and 8 comprises 8×8 single antennas 1 and is particularly suited for the operation in the 60 GHz frequency range. Here, the transition of the transmission structure 14 from a balanced microstrip line to a wave guide is depicted.

Figure 10:
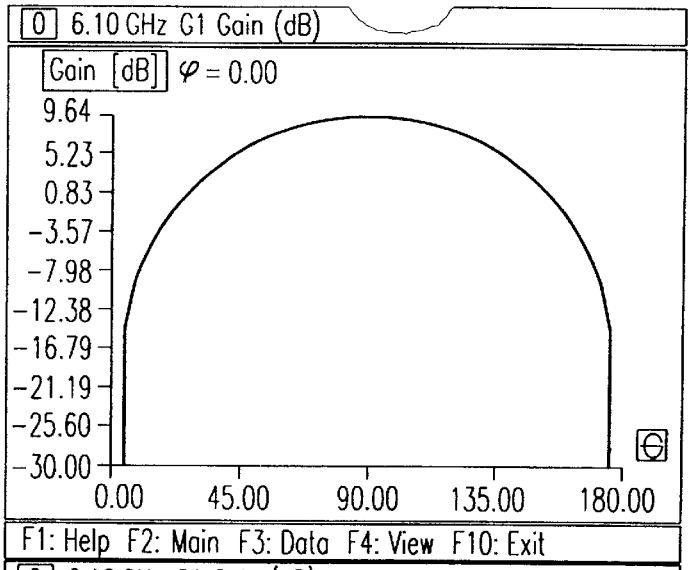
FIG. 10, FIG. 11 and FIG. 12 show the gain of a single element antenna according to the present invention for different rotation angles.
Figure 11:
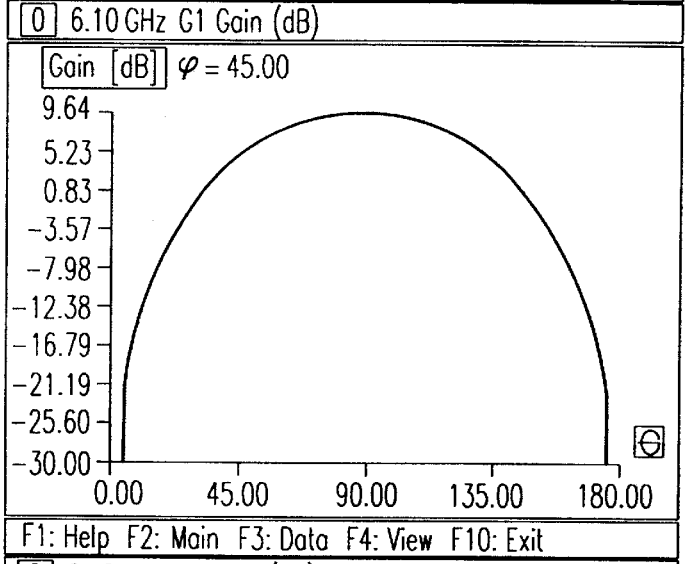
Figure 12:
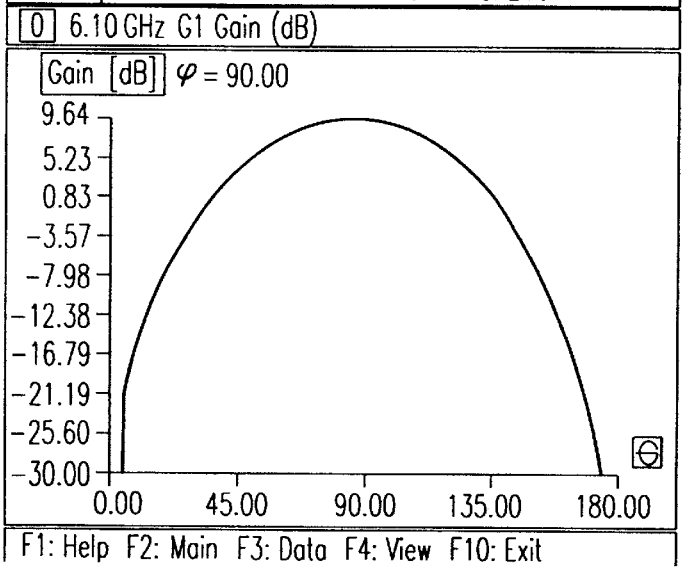

FIGS. 10, 11 and 12 show simulation results for the antenna gain for a single antenna 1 according to the present invention for different rotation angles at 61 GHz. FIG. 10 shows the antenna gain for a rotation angle $\phi=0°$, FIG. 11 shows the antenna gain for a rotation angle $\phi=45°$ and FIG. 12 shows the antenna gain for a rotation angle $\phi=90°$. As can be seen, the antenna gain for the single antennas 1 according to the present invention is quite how much in use for the different rotation angles.

Figure 13:
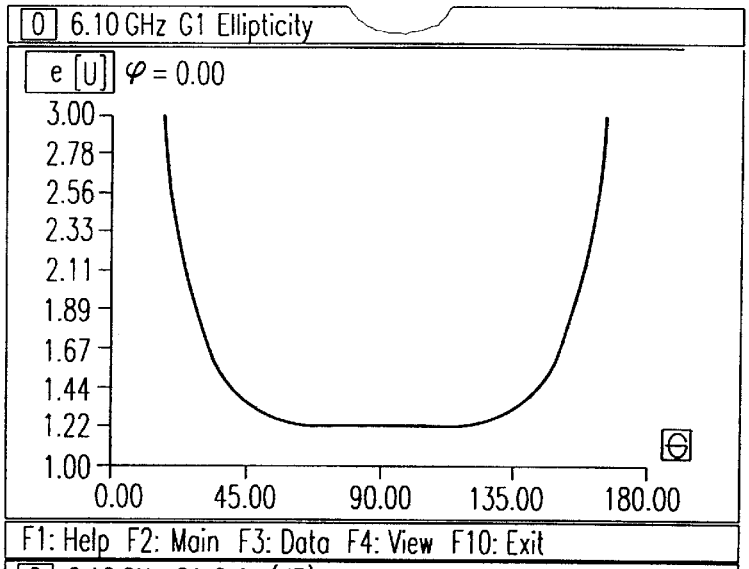
FIG. 13, FIG. 14 and FIG. 15 show the elipticity of the phased array antenna consisting of 4×4 single antennas according to the present invention having dipole means as shown in FIG. 1 for different rotation angles.
Figure 14:
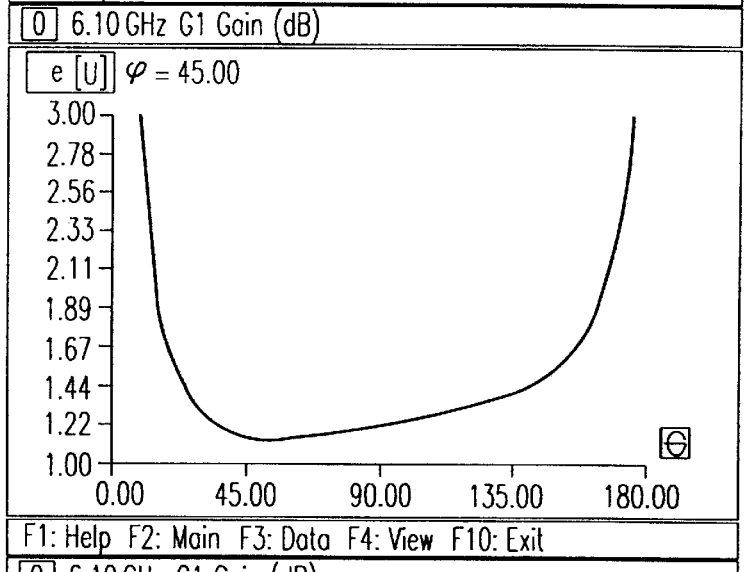
Figure 15:
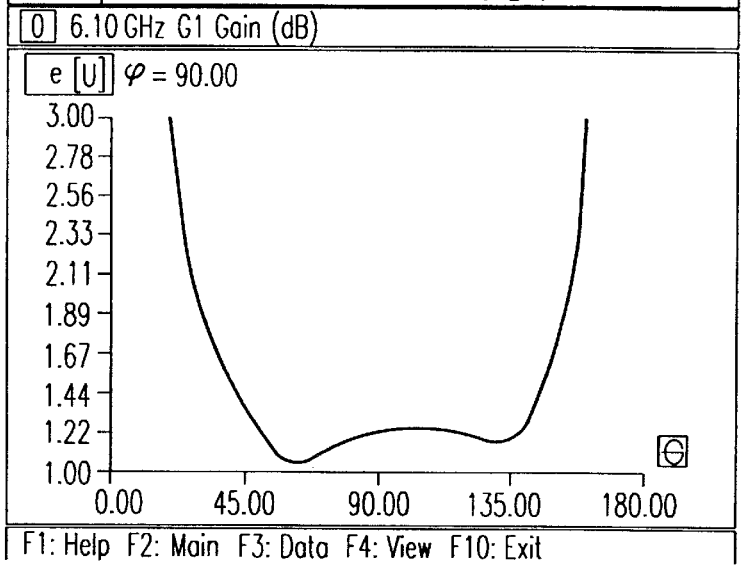

FIGS. 13, 14 and 15 show similation results for the elipticity of a phased array antenna comprising 4×4 single antennas 1 according to the present invention, each antenna 1 having a structure as shown in FIG. 1, for different rotation angles at 6.10 GHz. FIG. 13 shows the elipticity for a rotation angle $\phi=0°$, FIG. 14 shows the elipticity for a rotation angle $\phi=45°$ and FIG. 15 shows the elipticity for a rotation angle $\phi=90°$.

Figure 17:
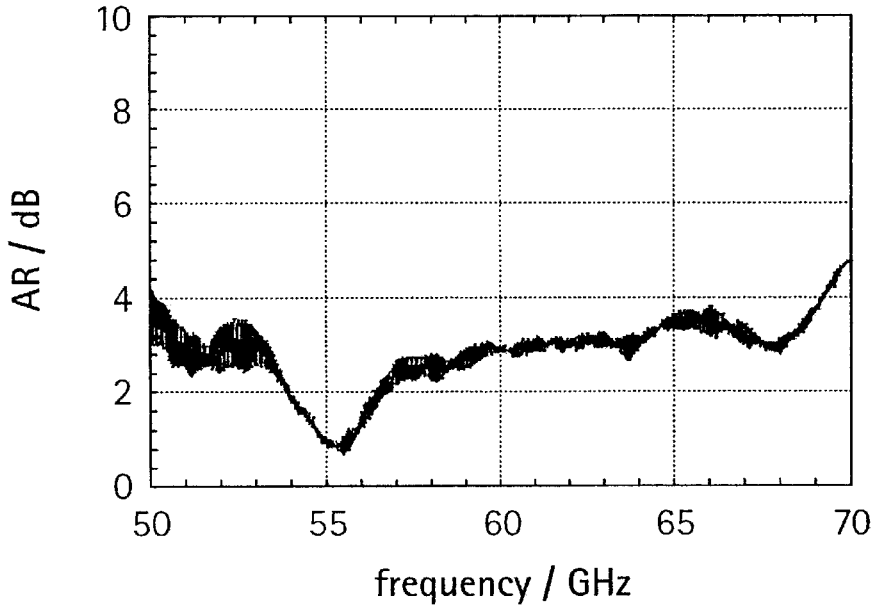
FIG. 17 shows a schematic diagram of the axial ratio over the frequency for a phased array antenna as used for the measurements for FIG. 16, but with holes in the substrate.
Figure 18:
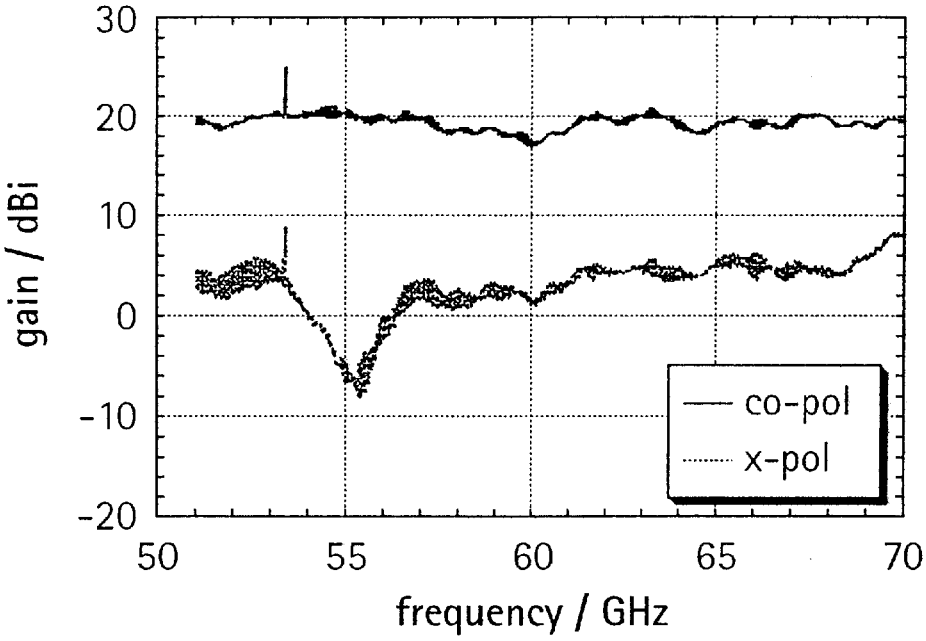
FIG. 18 shows a diagram of the measured gain versus the frequency for an antenna model according to the phased array antenna as shown in FIGS. 5 and 6.
Figure 19:
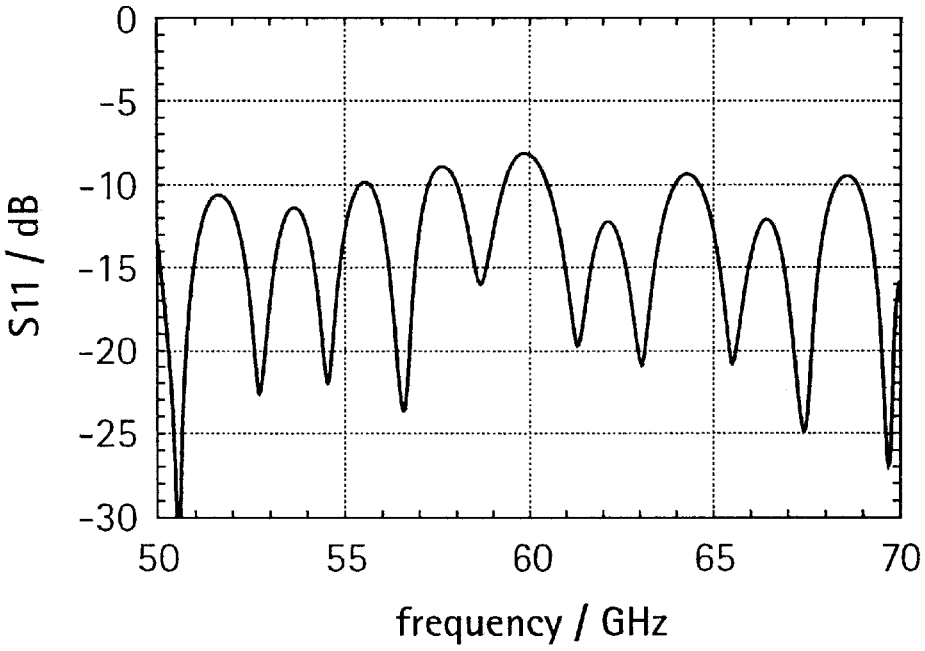
FIG. 19 shows a diagram of the measured input return loss versus the frequency for the phased array antenna as used for the measurements of FIG. 17.

FIG. 16 shows the diagram of the axial ratio in the main beam direction versus the frequency for a real model of a phased array antenna with 2×2 single antennas 1 according to the present invention with double ring tapes on the opposite sides of the substrate for a dielectric constant of 1 and of 2.17 for the dielectric substrate. FIG. 17 shows a diagram of the axial ratio versus the frequency for the phased array antenna used in FIG. 16 for a larger frequency range, whereby holes were provided in the substrate of the phased array antenna. FIG. 18 shows a diagram of the measured gain versus the frequency for a scaled realised model of a phased array antenna according to the structures shown in FIGS. 5 and 6, whereby the measured gain for both circular polarisations is shown. FIG. 19 shows a diagram of the measured input return loss versus the frequency for a phased array antenna used for the measurements in FIG. 17.

As can be seen, the gain, the axial ratio and the input return loss of a phased array antenna according to the present invention are good. The advantages of the antenna element and the phased array antenna according to the present invention are a particular high gain capability due to the larger possible number of radiation elements, a good axial ratio, the possible planar feeding and the entire planar structure of the phased array antenna. Further, the present invention enables to manufacture the antenna for deep mm-wave frequencies also at 60 GHz using conventional print technologies. Further, the small geometrical size and the shape of the dipole means of the antenna according to the present invention allows the integration of further front end processing element on the same substrate 2 were the antennas 1 are printed.

What is claimed is:

1. Antenna (1), comprising a dielectric substrate (2) comprising a front (3) and a back (4) dielectric face, at least one dipole means comprising a first (5) and a second (6) element for radiating and receiving electromagnetic signals, said first element (5) being printed on said front face (3) and said second element (6) being printed on said back face (4), said first and said second element having a spiral shape, respectively, both spirals being open, and metal feeding means for supplying signals to and from said dipole means, said metal feeding means comprising a first line (7) printed on said front face (3) and coupled to said first element (5) at a first feeding point and a second line (8) printed on said back (4) face and coupled to said second element (6) at a second feeding point, said first and said second feeding point overlapping each other.

2. Antenna (1) according to claim 1, characterized in, that said spirals formed by said first (5) and second (6) elements have a constant radius.

3. Antenna (1) according to claim 2, characterized in, that said spirals formed by said first (5) and second (6) elements form a loop in an annular range at about 350–359 degrees, respectively.

4. Antenna (1) according to claim 2, characterized in, that said spirals formed by said first (5) and second (6) elements respectively form less than one complete turn.

5. Antenna (1) according to claim 1, characterized in, that said spirals formed by said first (5) and second (6) elements respectively have a decreasing radius towards their respective open end.

6. Antenna (1) according to claim 5, characterized in, that said spirals formed by said first (5) and second (6) elements respectively form less than one complete turn.

7. Antenna (1) according to claim 5, characterized in, that said spirals formed by said first (5) and second (6) elements respectively form one complete turn.

8. Antenna (1) according to claim 5, characterized in, that said spirals formed by said first (5) and second (6) elements respectively form more than one complete turn.

9. Antenna (1) according to claim 1, characterized in, that a width of each of the first (5) and the second (6) elements respectively decreases toward a respective open end of the spirals.

10. Antenna (1) according to claim 1, characterized in, that a width of each of the first (5) and the second (6) elements respectively increases towards a respective open end of the spirals.

11. Antenna (1) according to claim 1, characterized in, that the first (7) and the second (8) lines of the metal feeding means are balanced microstrip lines.

12. Antenna (1) according to claim 1, characterized in, that the first (7) and the second (8) lines of the metal feeding means extend beyond a respective feeding point (9).

13. Antenna (1) according to claim 1, characterized by reflector means (11) being spaced to and parallel with said back face of the dielectric substrate (2), with a low loss material (12) being located between said reflector means (11) and said back face.

14. Antenna (1) according to claim 13, characterized by that said reflector means (11) are spaced from the middle of the substrate (2) by a quarter wave length of the center frequency of operation.

15. Phase array antenna (13) comprising a plurality of antennas (1), each of said antennas according to claim 1, said metal feeding means of said antennas being connected to metal transmission structures (14) respectively printed on said front face (3) and said back face (4) of said dielectric substrate (2).

16. Phase arrange antenna (13) according to claim 15, characterized in, that said transmission structures (14) are balanced and respectively comprise tapered microstrip lines (15).

17. Phase array antenna (13) according to claim 15, characterized in, that a plurality of holes (16) are provide (2).

* * * * *